US009447542B2

(12) United States Patent
Erkelenz et al.

(10) Patent No.: US 9,447,542 B2
(45) Date of Patent: Sep. 20, 2016

(54) SEALING STRIP SYSTEM

(71) Applicant: VOITH PATENT GMBH, Heidenheim (DE)

(72) Inventors: Marc Erkelenz, Ulm (DE); Jochen Honold, Schlingen (DE); Lisa Nagel, Neu-Ulm (DE); Joerg Spindler, Schwaebisch Gmuend (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/403,665

(22) PCT Filed: Apr. 11, 2013

(86) PCT No.: PCT/EP2013/057542
§ 371 (c)(1),
(2) Date: Mar. 11, 2015

(87) PCT Pub. No.: WO2013/174572
PCT Pub. Date: Nov. 28, 2013

(65) Prior Publication Data

US 2015/0184340 A1 Jul. 2, 2015

(30) Foreign Application Priority Data

May 25, 2012 (DE) ..... 10 2012 208 811

(51) Int. Cl.
*D21F 1/50* (2006.01)
*D21F 3/10* (2006.01)

(52) U.S. Cl.
CPC .. *D21F 1/50* (2013.01); *D21F 3/10* (2013.01)

(58) Field of Classification Search
CPC ..... D21F 3/10; D21F 7/00; D21F 1/50; Y10S 277/906; Y10S 277/913; F16J 15/162; F16J 15/064; F16J 15/16
See application file for complete search history.

(56) References Cited

U.S. PATENT DOCUMENTS

| | | | | | |
|---|---|---|---|---|---|
| 2,274,641 | A * | 3/1942 | Abbott | D21F 3/10 | 15/DIG. 7 |
| 2,578,551 | A * | 12/1951 | Hornbostel | D21F 3/10 | 162/371 |
| 4,714,523 | A * | 12/1987 | Sawyer, Jr. | D21F 3/10 | 162/369 |
| 4,915,787 | A * | 4/1990 | Branyon | D21F 3/10 | 162/199 |
| 5,746,891 | A | 5/1998 | Withers | | |

(Continued)

FOREIGN PATENT DOCUMENTS

| | | | | |
|---|---|---|---|---|
| CA | 2299814 | A1 * | 9/2000 | D21F 3/10 |
| DE | EP 0738801 | A2 * | 10/1996 | D21F 3/10 |
| DE | 102004059028 | A1 | 6/2006 | |
| DE | 102005052552 | A1 * | 5/2007 | D21F 3/10 |
| DE | 102007011659 | A1 * | 9/2008 | D21F 3/10 |
| DE | 102012208795 | A1 * | 11/2013 | D21F 3/10 |
| DE | WO 2014026920 | A1 * | 2/2014 | D21F 3/10 |
| FI | EP 1447471 | A1 * | 8/2004 | C09K 3/10 |
| FI | WO 2007003698 | A1 * | 1/2007 | D21F 3/10 |
| JP | 2005002546 | A * | 1/2005 | |
| WO | WO 9804776 | A2 * | 2/1998 | D21F 3/10 |
| WO | 03056215 | A1 | 7/2003 | |

OTHER PUBLICATIONS

Machine Translation of DE 102004059028 A1 Published on Jun. 14, 2006.*

*Primary Examiner* — Jose Fortuna
(74) *Attorney, Agent, or Firm* — Laurence A. Greenberg; Werner H. Stemer; Ralph E. Locher

(57) ABSTRACT

A sealing-strip system has a sealing strip for sealing a suction zone of a suctioned roller in a machine for manufacturing and/or processing a fibrous web. The sealing strip has a wear volume which is successively removed by tribological contact with the roller, and a wear-indication unit which is formed by at least one tube which is configured in or on the sealing strip and which is at least in part disposed on or in the sealing strip in the region of the wear volume.

10 Claims, 1 Drawing Sheet

(56) References Cited

U.S. PATENT DOCUMENTS

| | | | | |
|---|---|---|---|---|
| 6,436,241 | B1 | 8/2002 | Persson et al. | |
| 7,144,477 | B2 * | 12/2006 | Gleason, Jr. | D21F 3/10 162/198 |
| 7,569,265 | B2 * | 8/2009 | Boga | C09K 3/10 162/369 |
| 2004/0168603 | A1 * | 9/2004 | Boga | C09K 3/10 101/494 |
| 2005/0126732 | A1 | 6/2005 | Gleason, Jr. | |
| 2013/0328272 | A1 * | 12/2013 | Honold | D21F 1/50 277/345 |
| 2015/0184340 | A1 * | 7/2015 | Erkelenz | D21F 1/50 162/374 |
| 2015/0191872 | A1 * | 7/2015 | Erkelenz | D21F 3/10 277/500 |
| 2015/0204014 | A1 * | 7/2015 | Erkelenz | D21F 3/10 277/300 |

* cited by examiner

SEALING STRIP SYSTEM

BACKGROUND OF THE INVENTION

Field of the Invention

The invention relates to a sealing-strip system, in particular for monitoring the wear of a sealing strip, which is preferably used in a suctioned roller of a machine for manufacturing a fibrous web such as a paper, cardboard or tissue web. The sealing-strip system (1) has a sealing strip (2) for sealing a suction zone of a suctioned roller in a machine for manufacturing and/or processing the fibrous web. The sealing strip (2) has a wear volume (3), which is successively removed by tribological contact with the roller, and a wear-indication unit.

Sealing strips are required in paper-making machines in suctioned rollers which have one or more vacuum zones in order to maintain the vacuum. During the sealing operation the sealing strips here are subject to certain wear, since they are pressed against the rotating metal sleeve of the roller.

If sealing strips are fully or even only partially worn beyond the maximum wear measurement, this may lead to a collapse of the vacuum and thus to problems in the operation of the paper-making machine. In the worst case the paper-making machine has to be stopped in an unscheduled manner for rollers to be replaced.

Suction rollers are thus usually replaced in a preventive manner and subsequently refurbished to a schedule in order to replace the sealing strips in a preventive manner. The wear in sealing strips is in most cases the main reason for exchanging rollers. In comparatively rare cases suction rollers are replaced also for other reasons, such as defects in bearings, for example.

From the prior art a number of publications which are concerned with the monitoring of sealing strips are known; however, all previous solutions have not been satisfactory.

For example, a monitored sealing strip is disclosed in the laid-open document DE 10 2004 059028 A in which monitored sealing strip a wear-indication unit which has a measuring unit having a first and second portion and at least one indicator, which is incorporated into the sealing strip so as to represent a discrete wear level, is provided. Upon the indicator reaching the wear level a connection between the first and second portion is closed or interrupted.

US2005/126732 A discloses a system for monitoring sealing strips, which has a voltage tapper which interacts with metal tabs on the sealing strip.

WO03/056215 A and U.S. Pat. No. 6,436,241 B have sensors in the sealing-strip holder and in the sealing strip per se.

U.S. Pat. No. 5,746,891 A has a colored tab in the sealing strip, which visually indicates the maximum limit of wear. It is of particular disadvantage here that the roller has to be dismantled and the suction box has to be pulled out in order to be able to see the marking.

It is a fundamental common feature of the abovementioned known wear-indication systems that they do enable at least partial monitoring of the state of the sealing strip but are often complex in construction and installation and also cost-intensive and maintenance-intensive.

It is often not clearly visible to the operator of a paper-making machine whether a sealing strip is worn or defective, respectively. A reliable indicator which monitors the wear to date of the sealing strips and optionally delivers a mathematical estimate of the time when maximum wear is reached is thus lacking.

The operator of a paper-making machine is correspondingly forced to schedule preventive roller replacements based on his accumulated experience to date. If the service interval is too long, the sealing strip may fail prior thereto. If the service interval is too short, valuable production time is wasted. Moreover, sealing strips which have not yet used up the maximum reserve for wear and thus could have remained in use may potentially be replaced, which likewise is reflected in increased costs.

BRIEF SUMMARY OF THE INVENTION

It is thus an object of the invention to avoid the mentioned disadvantages of the prior art in that by means of a simple and cost-effective solution the wear of a sealing strip can be monitored and based on time stamps a prediction as to when the sealing strip will presumably reach maximum wear can be delivered.

The object is achieved by the characterizing features as claimed in conjunction with the generically determinative features.

According to the invention it is provided here that the sealing strip is provided with a wear-indication unit which is formed by a number of tubes which are disposed on or in the sealing strip in the region of the wear volume, filled with a suitable medium and are monitorable by way of a suitable measuring unit.

By means of the tubes it is possible for the wear of the sealing strip to be monitored in a simple manner during operation and for the data to be used for a wear prediction. On account thereof, unnecessary costs by premature dismantling of the roller or exchanging sealing strips which are not completely worn, respectively, and machine downtime due to web ruptures as a result of poor suction performance can be avoided, enabling more economical operation of the machine.

Further advantageous variants of design embodiments and more detailed aspects of the invention are derived from the dependent claims.

The tubes here may be configured at least in the region of the provided wear volume; or else a slightly larger extent may be of advantage in order to have reserves even in the case of excessive load or more rapid wear, respectively.

It is furthermore advantageous for the tubes to be at least in portions substantially oriented in a longitudinal direction of the sealing strip and to be approximately as long as the length of the sealing strip when viewed in the machine cross direction. On account thereof, monitoring across the entire length of the sealing strip is possible.

According to an advantageous aspect of the invention it may be provided for a single tube to be present, which tube is disposed in the region of the wear volume of the sealing strip that faces the suction box. If the tube is worn a signal is emitted which announces early servicing.

According to another advantageous aspect of the invention at least two tubes which are disposed in or on the wear volume so as to be on top of one another in the radial direction in relation to the suction box can be provided. On account thereof, continuous monitoring of the wear of the sealing strip can take place.

Preferably the at least one tube may be closed off at one end and by way of the other end be connectable to a supply unit via which the medium with which the at least one tube is filled is suppliable.

The supply unit may advantageously comprise at least one pressure gauge which continuously reflects the operational state of the tubes.

According to one variant of embodiment the medium which is present in the at least one tube may be air or water. These are advantageous solutions, since they are cost-effective.

The wear-indication unit may advantageously have at least one evaluation unit which is connected to the at least one tube. Processing of the data and the compilation of a wear prediction may take place here.

The tubes advantageously should be connected to the sealing strip in a form-fitting and/or force-fitting and/or materially integral manner, in order to ensure flawless functioning.

BRIEF DESCRIPTION OF THE SEVERAL VIEWS OF THE DRAWING

The invention is explained in more detail in the following with reference to the figures, in which.

DESCRIPTION OF THE INVENTION

Figure 1:
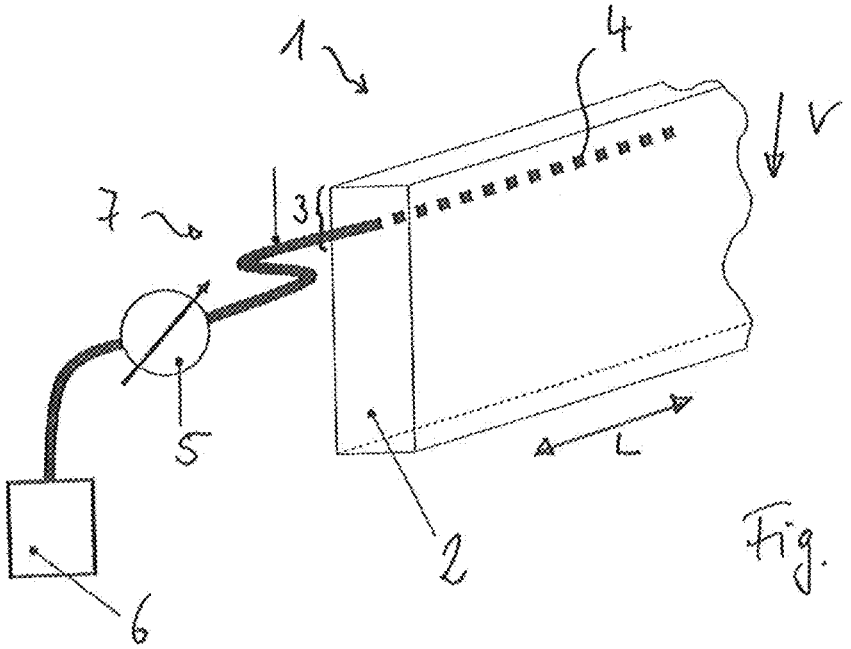
FIG. 1 shows a schematic perspective illustration of a sealing strip having a wear-indication unit which is designed according to the invention, having one tube.

In FIG. 1 an exemplary embodiment of the invention is illustrated in a simplified manner in a schematic perspective view. A sealing-strip system 1 here comprises a sealing strip 2 which is suitable for use in a suction box in a suctioned roller in a machine for manufacturing a fibrous web, in particular a paper, cardboard or tissue web. The sealing strip 2 here is usually disposed in a stationary suction box, the roller sleeve of the roller rotating about the latter. The sealing strip 2 bears on an inner face of the roller sleeve and allows the vacuum which is built up by the suction box to be maintained so as to be stable. On account of the vacuum, water is suctioned from the fibrous web and the fibrous web is held and deflected on the roller, respectively.

Caused by constant bearing on the sleeve face, which also has to take place at a minimal pressure, the sealing strip 2 is subjected to constant wear. The latter is limited in particular by geometric limitations in the readjustment and the contact pressure of the sealing strip 2. Therefore, it is desirable for the state of wear of the sealing strip 2 to be observed and optionally for servicing to be scheduled by way of a prediction of the service life.

The illustration and more detailed description of the suction box and of the roller is dispensed with here for reasons of clarity. The mentioned components have represented the prior art for a long time.

Figure 2:
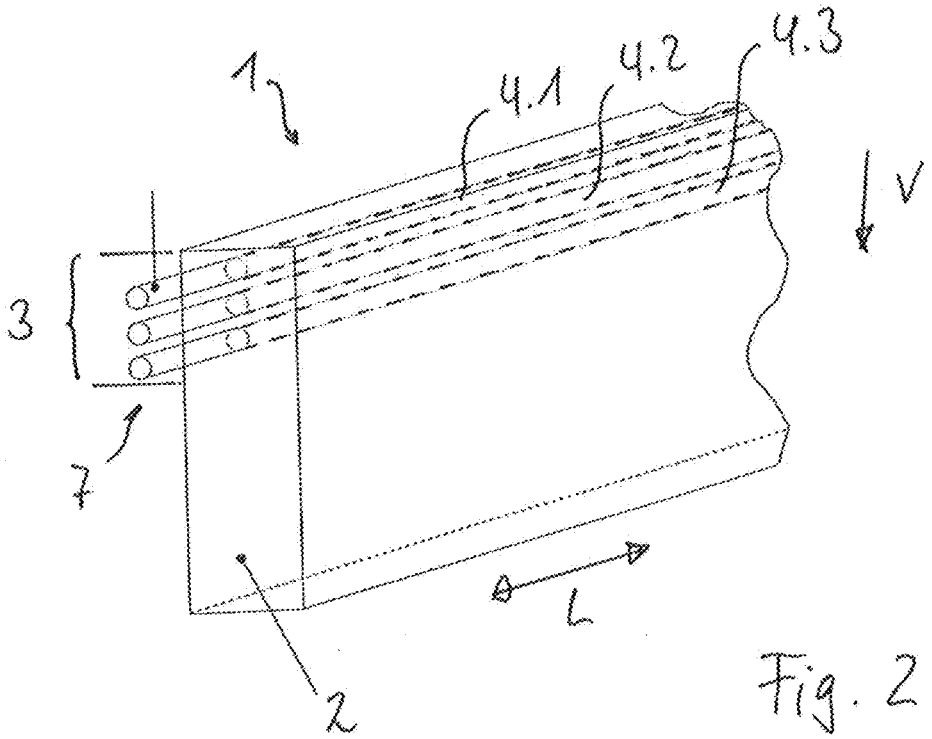
FIG. 2 shows a schematic perspective illustration of a further sealing strip having a wear-indication unit which is designed according to the invention, having three tubes.

According to the invention a wear-indication unit 7 for observing the wear of the sealing strip 2 is provided. As illustrated in FIG. 2, said wear-indication unit 7 has a number of tubes 4.1, 4.2, . . . , **4.*n*, but at least one tube 4, as indicated in FIG. 1, disposed on or in the sealing strip 2**, in order to emit a reliable prediction as to the wear behavior and to be able to determine therefrom service intervals or residual service life, respectively.

The tubes 4.1, 4.2, . . . , **4.*n* here are disposed such that they are disposed on top of one another in a wear direction V of the sealing strip 2 and extend in a longitudinal direction L of the sealing strip 2. The tubes 4.1, 4.2, . . . , 4.*n* should preferably extend across the entire length of the sealing strip 2**.

The tubes 4.1, 4.2, . . . , **4.*n*** are filled with a suitable medium, such as air or water, for example, wherein the filling level or the pressure of the medium, respectively, is monitorable by way of suitable devices.

In FIG. 1 initially a simplified exemplary embodiment is illustrated, in which exemplary embodiment only a single tube 4, which is correspondingly disposed in or on the sealing strip 2 such that said single tube 4 indicates the foreseeable service requirement, is provided. To this end, the tube 4 is sensibly disposed in that region of the wear volume 3 that is closest to the suction box, that is to say at the bottom as seen in relation to the wear direction. Here, no observation of the temporal profile of the wear of the sealing strip would be possible; rather early maintenance is to be rapidly planned. Instead, this variant impresses with simplicity, low susceptibility to errors and low manufacturing and maintenance complexity.

In FIG. 2 a sealing strip 2 in which three tubes 4.1, 4.2, 4.3 are provided is illustrated. Said three tubes are embedded in the material of the sealing strip 2, which, for example, may take place directly in the manufacture of the sealing strip 2 or only later on. The tubes 4.1, 4.2, 4.3 may also be disposed in a groove in the sealing strip 2 and fixed so as to be capable of expansion. Various possibilities of fixing, which may comprise a force-fit, a form-fit or a materially integral fit, are conceivable, such as adhesively bonding the tubes 4.1, 4.2, . . . , **4.*n* to an outer face of the sealing strip 2**, for example.

The at least one tube 4.1, 4.2, . . . , **4.*n* is closed off at one end and on the other end connected to a suitable supply unit for impinging the at least one tube 4.1, 4.2, . . . , 4.*n* with a pressurized medium, such as air or water, for example. At least one pressure gauge 5 which is assigned to the supply unit serves for checking the pressure present in the at least one tube 4.1, 4.2, . . . , 4.*n***.

If the wear volume 3 of the sealing strip 2 is removed and the at least one tube 4.1, 4.2, . . . , **4.*n* is thereby damaged in an arbitrary spot, the medium contained therein, for example the air or water, escapes and the at least one pressure gauge senses sinking pressure in the tube 4.1, 4.2, . . . , 4.*n*. Alternatively, minor outflow of the medium on account of minor damage in the tube 4.1, 4.2, . . . , 4.*n*** may be compensated for, and a change in the volumetric flow may be measured instead of sinking pressure in the case of expanding damage.

In the case of water being used as a medium for filling the tubes 4.1, 4.2, . . . , **4.*n*** it is moreover conceivable for the water leaking out in the case of damage to be employed as a lubricant in the sense of an emergency measure.

Furthermore, as illustrated in FIG. 1, an evaluation unit 6 which records the values of the at least one pressure gauge 5 and accordingly places a time stamp is provided. By way of a comparison of the time stamps, the wear of the sealing strips or the potential residual service life, respectively, can be determined, enabling personnel to plan servicing downtime of the paper-making machine for exchanging the sealing strips 2.

Ideally, so many tubes 4.1, 4.2, . . . , **4.*n* are provided that the entire wear volume 3 of the sealing strip 2 is covered. For example, if the wear of the sealing strip 2 is adapted to be 10 mm, the tubes 4.1, 4.2, . . . , 4.*n*** are accordingly adapted in number and in arrangement to at least this dimension or exceed the latter in certain circumstances, in order to show further potential for wear.

In the course of operation of the sealing strip 2 the wear volume 3 is removed bit-by-bit, such that the tubes 4.1, 4.2, . . . , **4.*n*** are gradually exposed. The corresponding measured values of the residual pressure then permit an exact determination of wear and residual service life.

Along with the wear of the sealing strip 2, initially one tube 4 is rubbed, such that the latter is subjected to pressure loss on account of escaping air or water, which pressure loss can be identified and indicated by the pressure gauge 5. This process is repeated as wear of the sealing strip 2 continues, until all tubes 4.1, 4.2, . . . , 4.*n* are worn out.

Since the spacings of the tubes 4.1, 4.2, . . . , 4.*n* in relation to one another in the system concept are known from the outset, it is possible to draw a conclusion as to how many of the tubes 4.1, 4.2, . . . , 4.*n* have been severed or which proportion of the wear volume 3 of the sealing strip 2 has already been worn out, respectively.

Indeed, an exact determination of the location of wear is not possible in the case of this system; however, this is also not necessarily of interest, since replacement of the sealing strip 2 has to always be performed when maximum wear has been reached. It is irrelevant here, at which spot, when seen in the axial direction, maximum wear takes place.

The described sealing-strip system 1 having the wear-indication system 4 is thus distinguished in that real-time observation by way of continuous measurement of sealing-strip wear across the entire length of the sealing strip 2 is possible. Likewise, a mathematical estimate as to the residual service life of the sealing strip 2 and cost-effective use of the sealing strips 2 are possible. The entire wear allocation can be utilized without running the risk of an unscheduled stoppage. The design embodiment according to the invention is cost-effective, since no sensors are used. Better planning of downtime and service intervals is possible on account thereof.

The invention claimed is:

1. A sealing-strip system for a suctioned roller in a machine for manufacturing and/or processing a fibrous web, comprising:

a sealing strip for sealing a suction zone of a suctioned roller in a machine for manufacturing and/or processing a fibrous web, said sealing strip having a wear volume to be successively removed by tribological contact with the roller;

a wear-indication unit formed with at least one tube disposed, at least in part, in said sealing strip in a region of said wear volume and being filled with a medium, and said wear-indication unit further including an evaluation unit communicating with said at least one tube.

2. The sealing-strip system according to claim 1, wherein said at least one tube, at least in portions thereof, is oriented to substantially extend along a longitudinal direction of said sealing strip and disposed to substantially extend along an entire length of said sealing strip.

3. The sealing-strip system according to claim 1, wherein said at least one tube is a single tube disposed in the region of said wear volume facing a suction box.

4. The sealing-strip system according to claim 1, wherein said at least one tube is one of at least two tubes disposed in or on said wear volume one above another in a radial direction relative to a suction box.

5. The sealing-strip system according to claim 4, wherein said tubes are disposed at least in the region of said wear volume and extend beyond said wear volume in a residual volume of said sealing strip.

6. The sealing-strip system according to claim 1, wherein said at least one tube is closed off at one end and by way of another end is connectable to a supply unit for supplying the medium.

7. The sealing-strip system according to claim 6, wherein the supply unit includes at least one pressure gauge.

8. The sealing-strip system according to claim 1, wherein the medium is air or water.

9. The sealing-strip system according to claim 1, wherein said wear-indication unit includes an evaluation unit connected to said at least one tube.

10. The sealing-strip system according to claim 1, wherein said at least one tube is connected to said sealing strip by one or more connections selected from the group consisting of a form-fitting connection, a force-fitting connection, and a materially integral connection.

* * * * *